US006591939B2

(12) United States Patent
Smullin et al.

(10) Patent No.: US 6,591,939 B2
(45) Date of Patent: Jul. 15, 2003

(54) MARINE ENGINE SILENCER

(75) Inventors: Joseph I. Smullin, Swampscott, MA (US); Matthew E. Denis, Marblehead, MA (US)

(73) Assignee: Smullin Corporation, Marblehead, MA (US)

( * ) Notice: Subject to any disclaimer, the term of this patent is extended or adjusted under 35 U.S.C. 154(b) by 3 days.

(21) Appl. No.: 09/844,712

(22) Filed: Apr. 27, 2001

(65) Prior Publication Data

US 2002/0020581 A1 Feb. 21, 2002

Related U.S. Application Data

(60) Provisional application No. 60/200,210, filed on Apr. 28, 2000.

(51) Int. Cl.[7] ..... F01N 1/14

(52) U.S. Cl. ..... 181/260; 181/262; 181/272

(58) Field of Search ..... 181/235, 259, 181/260, 261, 262, 263, 265, 269, 272, 233, 234; 440/88, 89; 96/236, 267, 239

(56) References Cited

U.S. PATENT DOCUMENTS

| | | | |
|---|---|---|---|
| 784,833 | A | 3/1905 | Brush |
| 1,015,955 | A | 1/1912 | Helder |
| 1,065,707 | A | 6/1913 | Montgomery |
| 1,076,571 | A | 10/1913 | Hall, Jr. |
| 1,127,807 | A | 2/1915 | Perkins |
| 1,759,679 | A | 5/1930 | Backman |
| 1,816,371 | A | 7/1931 | Hefti |
| 1,938,849 | A | 12/1933 | Maxim et al. |
| 2,360,429 | A | 10/1944 | Leadbetter |
| 2,498,979 | A | 2/1950 | Bourne |

(List continued on next page.)

FOREIGN PATENT DOCUMENTS

| | | |
|---|---|---|
| AU | 741927 | 3/2002 |
| GB | 344735 | 3/1931 |

OTHER PUBLICATIONS

Boating Industry Magazine, Jul. 1997 at 61.

Centek Industries, Inc., Product Information Catalog (1997).

Perry et al., "Phase Separation," Chemical Engineers' Handbook, Fourth Edition, Copyright© 1963 by McGraw–Hill, Inc., pp. 18–82 to 18–86.

Soundown Waterdrop$_{TM}$ Silencer Product Information, Undated.

*Primary Examiner*—Khanh Dang
(74) *Attorney, Agent, or Firm*—Wolf, Greenfield & Sacks, P.C.

(57) ABSTRACT

A silencer is disclosed that reduces the acoustic energy of a fluid mixture of a liquid coolant and of exhaust gas from an engine. The engine may be a marine engine. The silencer according to this aspect includes a receiving chamber that receives the fluid mixture and exhaust gas, at least one lifting conduit; and a separation chamber. The lifting conduit has a receiving portion with a first opening and an expelling portion with a second opening. The receiving portion is fluidly coupled with the receiving chamber so that the fluid mixture enters the first opening from the receiving chamber and is lifted through the lifting conduit to the expelling portion. This lifting may be accomplished, at least in part, by dynamic effects. The separation chamber is fluidly coupled with the second opening of the lifting conduit, and has at least one interior surface. The expelling portion of the lifting conduit is disposed so that fluid mixture expelled from the second opening is directed toward the at least one interior surface of the separation chamber. The at least one interior surface may dynamically separate, for example by linear momentum effect or centrifugal effect, at least a portion of the exhaust gas from the fluid mixture.

39 Claims, 10 Drawing Sheets

U.S. PATENT DOCUMENTS

| | | | | | |
|---|---|---|---|---|---|
| 2,961,059 | A | | 11/1960 | Blair | |
| 3,291,252 | A | | 12/1966 | Davis | |
| 3,296,997 | A | | 1/1967 | Hoiby et al. | |
| 3,431,882 | A | | 3/1969 | Irgens | |
| 4,019,456 | A | | 4/1977 | Harbert | |
| 4,184,566 | A | | 1/1980 | Baker et al. | |
| 4,310,067 | A | | 1/1982 | Thomson | |
| 4,315,559 | A | * | 2/1982 | Casey | 181/265 |
| 4,416,350 | A | | 11/1983 | Hayashi | |
| 4,601,666 | A | | 7/1986 | Wood, Jr. | |
| 4,678,442 | A | | 7/1987 | Nishida et al. | |
| 4,713,029 | A | | 12/1987 | Ford | |
| 4,917,640 | A | | 4/1990 | Miles, Jr. | |
| 5,022,877 | A | | 6/1991 | Harbert | |
| 5,041,036 | A | | 8/1991 | Clark et al. | |
| 5,045,005 | A | | 9/1991 | Miles, Jr. | |
| 5,147,232 | A | | 9/1992 | Miles, Jr. et al. | |
| 5,196,655 | A | | 3/1993 | Woods | |
| 5,259,797 | A | | 11/1993 | Miles, Jr. et al. | |
| 5,550,337 | A | | 8/1996 | Tazaki et al. | |
| 5,554,058 | A | | 9/1996 | LeQuire | |
| 5,588,888 | A | | 12/1996 | Magharious | |
| 5,594,217 | A | | 1/1997 | LeQuire | |
| 5,625,173 | A | | 4/1997 | Woods | |
| 5,746,630 | A | | 5/1998 | Ford et al. | |
| 6,024,617 | A | | 2/2000 | Smullin et al. | |
| 6,045,422 | A | | 4/2000 | Widmann | |
| 6,273,772 | B1 | | 8/2001 | Smullin | |

* cited by examiner

MARINE ENGINE SILENCER

CROSS REFERENCE TO RELATED APPLICATIONS

This application is related to provisional application serial No. 60/200,210, filed Apr. 28, 2000, priority to such application being claimed under 35 U.S.C. §119(e). Such application is hereby incorporated by reference in its entirety as though set forth in full herein. This application is also related to U.S. patent application Ser. No. 09/349,871, filed Jul. 8, 1999, which is also hereby incorporated by reference in its entirety as though set forth in full herein.

FIELD OF THE INVENTION

The invention relates to devices and methods for silencing engines. More particularly, the invention relates to devices and methods for silencing marine engines. Still more particularly, the invention relates to devices and methods for silencing marine engine wet exhaust gas using water separation techniques.

BACKGROUND OF THE INVENTION

The present invention belongs to the general class of internal combustion engine exhaust silencers or mufflers that may be characterized as attempting to achieve a "cold, wet/dry" condition, as contrasted with a "cold, wet" or "hot, dry" conditions, for extracting acoustic energy from exhaust gas. A "cold, wet/dry" condition is one in which a liquid coolant, typically water, first has been added to the exhaust gas of an engine, typically a marine engine, in order to reduce the temperature of the exhaust gas (the "cold, wet" stage), and then the water has been separated from the gas (the "dry" stage) in preparation for further reduction of the acoustic energy of the "dry" gas. The reduction in temperature is desireable for two reasons. First, the lower temperature reduces the acoustic velocity in the gas, that is, the speed at which sound propagates through the gas. The lower the acoustic velocity, the smaller the chamber that may be used to achieve a given reduction in acoustic energy, or noise. Alternatively, greater noise reduction can be achieved in a given space. Second, as the exhaust gas cools, it becomes denser. Thus, the dynamic pressure of the gas passing through a tube of a given size is reduced, resulting in a reduction in the pressure drop through the tube, and, consequently, a smaller "back pressure" effect. Back pressure is undesireable because it may interfere with the efficient operation of the engine or may damage it.

One undesireable attribute of cold, wet marine-exhaust silencers is that the reduction in back pressure achieved by water cooling, as just described, is offset as a consequence of the presence of water mixed with the gas. The denser net mass of the inhomogeneous water-gas mixture, as compared to a cold, wet/dry system in which the water has been removed, or as compared to a hot, dry system in which water was never added, results in an increase in back pressure. In order to avoid excessive back pressure, water-gas velocities in cold, wet exhaust systems are generally held to a range of 20 to 50 feet per second (fps). This velocity restriction places requirements on the sizes of pipes, which in some cases makes the silencers larger or less effective than desirable. Moreover, whereas in a "dry" gas silencer, i.e., either a "hot, dry" or "cold, wet/dry" silencer, the "dry gas" may be conducted to a remote discharge point using a routing of both upward and downward pitched piping, such routing is often impracticable in a "wet" silencer because of an unacceptably large increase in back pressure for upward pitches and for corners. Because the appropriate discharge of exhaust gas from the vessel may be an important safety and convenience consideration, the limitation on discharge-pipe routing imposed by mixed water and gas discharge can impose a serious design problem or constraint.

In general, prior art marine-exhaust silencers have not optimally balanced the benefits of water cooling with the need to reduce back pressure while minimizing the size of the silencer. More specifically, some prior art marine-exhaust silencers attempt to operate in a "cold, wet/dry" condition but fail to achieve sufficient separation of the water from the gas. Other designs improve on such separation at the expense of large size and reduced flexibility of configuration.

For example, U.S. Pat. Nos. 5,022,877 and 4,019,456 to Harbert rely on gravitational effects and condensation to separate the exhaust gas from the water coolant, thus only partially achieving a "cold, wet/dry" condition. Greater separation using these means could be achieved, but at the expense of increasing the size of the silencer; i.e., by providing a larger free surface of the gas-water mixture through which the gas could rise, or at the expense of increased back pressure due to elaborate flow control. U.S. Pat. No. 4,917,640 to Miles employs such an approach by providing a more complex configuration of tubular separation chambers. Another approach, disclosed in U.S. Pat. No. 5,588,888 to Maghurious, is to agitate the wet mixture of exhaust gas and water in order to atomize the water droplets in the mixture and thereby increase the absorption of acoustic energy by the water mass. This approach is a variation of a cold, wet design in that it relies upon reduction in the acoustic energy of the exhaust gas before it is fully separated from the water, thereby incurring the penalties associated with cold, wet systems already noted.

Other techniques use waterlift silencers such as that described in U.S. Pat. No. 3,296,997 to Hoiby et al. In the Hoiby device, the mixture of cooling water and exhaust gas is introduced into a chamber through an inlet pipe. An exit tube extends vertically through the top of the chamber. The bottom of the exit tube is spaced from the bottom of the chamber so that the mixture may enter the bottom of the tube and be expelled. As described by Hoiby, the gas separates from the water in the chamber and, when the dynamic pressure in the chamber is such as to force water up the outlet tube, the level of the water surface in the chamber reduces to an extent allowing direct expulsion of gas through the tube. The kinetic energy of the gas escaping through the tube partially atomizes the water, according to Hoiby, and entrains the atomized liquid particles. The entrained liquid is thus carried, along with the exhaust gas, up through the exit tube. A similar design is shown in U.S. Pat. No. 5,554,058 to LeQuire. U.S. Pat. No. 2,360,429 to Leadbetter is one type of silencer that uses water to silence exhaust gas and includes multiple chambers.

U.S. Pat. No. 6,024,617 to Smullin et al., incorporated herein by reference in its entirety, discloses a silencer wherein a fluid mixture enters a separation chamber having an in-flow port for receiving the fluid mixture, and an out-flow port for the separated exhaust gas, and a liquid-coolant out-flow port. The separation chamber contains a separation plate having at least one dynamic separator for separating the exhaust gas from the liquid coolant by inertial or frictional effects, or both, using a series of vanes or a mesh pad.

Also, U.S. patent application Ser. No. 09/349,871 is incorporated herein by reference in its entirety. This application discloses using multiple lifting tubes, the height of the bottoms of different tubes can be differentially set, to allow the flow to be sequentially enabled in the different tubes for the purpose of generating sound attenuating benefits.

SUMMARY OF THE INVENTION

In one aspect of the invention, a silencer is disclosed that reduces the acoustic energy of a fluid mixture of a liquid coolant and of exhaust gas from an engine. The engine may be a marine engine. The silencer according to this aspect includes a receiving chamber that receives the fluid mixture, at least one lifting conduit; and a separation chamber. The lifting conduit has a receiving portion with a first opening and an expelling portion with a second opening. The receiving portion is fluidly coupled with the receiving chamber so that the fluid mixture enters the first opening from the receiving chamber and is lifted through the lifting conduit to the expelling portion. This lifting may be accomplished, at least in part, by dynamic effects. The separation chamber is fluidly coupled with the second opening of the lifting conduit, and has at least one interior surface. The at least one interior surface may include an extending member. The expelling portion of the lifting conduit is disposed so that fluid mixture expelled from the second opening is directed toward the at least one interior surface of the separation chamber. The at least one interior surface may be configured and arranged to dynamically separate at least a portion of the exhaust gas from the fluid mixture. This portion of the exhaust gas may be referred to as "dry gas." The dry gas typically includes some of the liquid coolant from the fluid mixture. Also, the liquid coolant that is separated from the fluid mixture may include some exhaust gas. That is, the separation of the fluid mixture into exhaust gas and liquid coolant when the fluid mixture is expelled toward the interior surface of the separation chamber may not be a complete separation. In some implementations of the invention, the dynamic separation occurs at least in part due to linear momentum effects. In some implementations the dynamic separation occurs at least in part due to centrifugal effects.

The lifting conduit may include a first discharge pipe having a receiving portion disposed within the receiving chamber and having an expelling portion disposed within the separation chamber. The expelling portion is configured and arranged to direct the fluid mixture with an angular momentum as it is expelled and, when the fluid mixture contacts the interior surface of the separation chamber, at least a portion of the exhaust gas is separated from the fluid mixture at least in part by a centrifugal effect. The interior surface of the separation chamber may include a tubular lateral cross section. The interior wall of the separation chamber may be circular, or partially curved, so that when the fluid mixture contacts the curved surface with an angular momentum, it swirls around the interior wall. In some implementations, the expelling portion of the lifting conduit may further be configured and arranged to direct the fluid mixture with a downward momentum as it is expelled.

In some implementations, the receiving portion of the first discharge pipe may include an opening disposed at a first distance above a first surface of the receiving chamber. A second lifting conduit includes a second discharge pipe. This second discharge pipe has a receiving portion disposed within the receiving chamber and has an expelling portion disposed within the separation chamber configured and arranged to direct the fluid mixture with an angular momentum as it is expelled. When the fluid mixture contacts the interior surface of the separation chamber, at least a portion of the exhaust gas is separated from the fluid mixture at least in part by a centrifugal effect. The receiving portion of the second discharge pipe includes an opening disposed at a second distance above the first surface of the receiving chamber. The first distance may not be the same distance as the second distance. The first discharge pipe may be dynamically operative for lifting the fluid mixture when the fluid mixture has a free-surface distance above the first surface of the receiving chamber that is within a first range of distances. The second discharge pipe may be dynamically operative for lifting the fluid mixture when the fluid mixture has a free-surface distance above the first surface of the receiving chamber that is within a second range of distances including a threshold distance above which the second discharge pipe is not dynamically operative. Some other aspects of dynamic operation of the dual or multiple discharge pipes are described in U.S. patent application Ser. No. 09/349,871, referred to above and incorporated by reference herein.

The receiving chamber may, in some aspects of the invention, have a fluid mixture inlet port. The silencer in these aspects includes at least one inlet conduit having a discharge end fluidly coupled to the fluid mixture inlet port and through which the fluid mixture is received into the receiving chamber.

In some aspects, the separation chamber has at least one liquid coolant discharge port. The silencer in these aspects includes at least one liquid coolant discharge conduit, each having a receiving end fluidly coupled to a liquid coolant discharge port and through which the liquid coolant is discharged from the separation chamber.

The separation chamber may have at least one exhaust gas discharge port through which dry gas is discharged from the separation chamber. The silencer may have an expulsion chamber having at least one exhaust gas inlet port, each gaseously coupled to an exhaust gas discharge port of the separation chamber. At least one exhaust gas inlet port of the expulsion chamber and at least one exhaust gas discharge port of the separation chamber may comprise the same port. The silencer may also have one or more resonator tubes. Each of the tubes has a first portion disposed within the separation chamber through an exhaust gas discharge port of the separation chamber, and also has a second portion disposed within the expulsion chamber through an exhaust gas inlet port of the expulsion chamber. The dry gas is discharged from the separation chamber, through the one or more resonator tubes, into the expulsion chamber. In some implementations, the second portions of the resonator tubes are configured and arranged to direct the dry gas that is discharged through them into the expulsion chamber with angular momentum, a first angular momentum. Also, the lifting conduit may include a discharge pipe that has a receiving portion disposed within the receiving chamber and that has an expelling portion disposed within the separation chamber and configured and arranged to direct the fluid mixture with an angular momentum, a second angular momentum, as it is expelled. When the fluid mixture contacts the interior surface of the separation chamber, at least a portion of the exhaust gas is separated from the fluid mixture at least in part by a centrifugal effect. The second angular momentum is based at least in part on a directional component opposite to that of a directional component on which the first angular momentum is based at least in part.

The second portion of the resonator tube may be disposed so that the dry gas discharged through it is directed toward the at least one interior surface of the expulsion chamber. As noted, because prior separation typically may not be complete, the dry gas discharged through the first resonator tube may include residual liquid coolant. Additional separation of the residual liquid coolant from the dry gas may be achieved due to centrifugal effects when the dry gas is discharged from the resonator tube.

In yet additional aspects, the lifting conduit includes a dam. The two sides of the dam may be referred to for convenience as the receiving side and expelling side. Each side has first and second portions. The dam includes a directing member generally disposed across the top of the dam. The directing member may be disposed adjacent to the first portion of the receiving side so that the expelling portion of the lifting conduit includes the first portions of the receiving and expelling sides and the directing member. The first opening of the lifting conduit is disposed adjacent the second portion of the receiving side, and the second opening of the lifting conduit is disposed adjacent the first portion of the expelling side. The separation chamber has a bottom interior surface, and, in some implementations, the directing member is disposed so that the fluid mixture expelled through the second opening is directed at least partially downward toward the bottom interior surface of the separation chamber. The separation chamber may include a liquid coolant receiving chamber.

In another aspect, a method is disclosed for reducing the acoustic energy of a fluid mixture of a liquid coolant and of exhaust gas from an engine. The method includes the steps of: receiving the fluid mixture in a receiving chamber; lifting the fluid mixture through a lifting conduit; and expelling the lifted fluid mixture toward an interior surface of the separation chamber. The method may also include the further step, when the fluid mixture contacts the interior surface, of dynamically separating at least a portion of the exhaust gas from the fluid mixture. The dynamically separating step may include dynamically separating by a linear momentum effect or by a centrifugal effect. The lifting step may include dynamic lifting.

In this method, the lifting conduit may include a discharge pipe having a receiving portion disposed within the receiving chamber and having an expelling portion disposed within the separation chamber. The expelling step in this aspect may include directing the fluid mixture with an angular momentum as it is expelled. The expelling step may further include directing the fluid mixture with a downward momentum as it is expelled. Another step may be that of discharging the dry gas through one or more resonator tubes into an expulsion chamber. This step may include directing the dry gas discharged through it into the expulsion chamber with a first angular momentum. The step of dynamically separating at least a portion of the exhaust gas from the fluid mixture may include the step of directing the fluid mixture with a second angular momentum. The second angular momentum may be based at least in part on a directional component opposite to that of a directional component on which the first angular momentum is based at least in part.

In some aspects of the method, the lifting conduit includes a dam having generally opposing receiving and expelling sides each having first and second portions. The dam also has a directing member generally transverse with the receiving and expelling sides and disposed adjacent to the first portion of the receiving side. In these aspects of the method, the expelling step may include the step of expelling the fluid mixture through an expelling portion of the dam comprising the first portions of the receiving and expelling sides and the directing member. In some implementations of the method, the separation chamber has a bottom interior surface. The expelling step in these implementations further includes the step of expelling the fluid mixture through the expelling portion of the dam so that the fluid mixture is directed downward toward the bottom interior surface of the separation chamber. The separation chamber may include a liquid coolant receiving chamber.

In one aspect of the invention, a silencer is provided for reducing the acoustic energy of a fluid mixture of a liquid coolant and of exhaust gas from an engine. The silencer comprises a receiving chamber that receives the fluid mixture. At least one lifting conduit is provided having a receiving portion including a first opening and having an expelling portion including a second opening. The receiving portion is fluidly coupled with the receiving chamber so that the fluid mixture enters the first opening from the receiving chamber and is lifted through the lifting conduit to the expelling portion. A separation chamber is provided fluidly coupled with the second opening and having at least one interior surface, wherein the expelling portion is disposed so that a fluid mixture expelled from the second opening is directed toward the at least one interior surface. One or more resonator tubes are included. Each resonator tube having a first portion disposed within the separation chamber through an exhaust gas discharge port of the separation chamber and having a second portion disposed within an expulsion chamber through an exhaust gas inlet port of the expulsion chamber. At least a portion of the exhaust gas is discharged from the separation chamber, through the one or more resonator tubes, into the expulsion chamber.

BRIEF DESCRIPTION OF THE DRAWINGS

The objects, features and advantages of this invention will be more clearly appreciated from the following detailed description when taken in conjunction with the accompanying drawings, in which.

DETAILED DESCRIPTION

Figure 1:
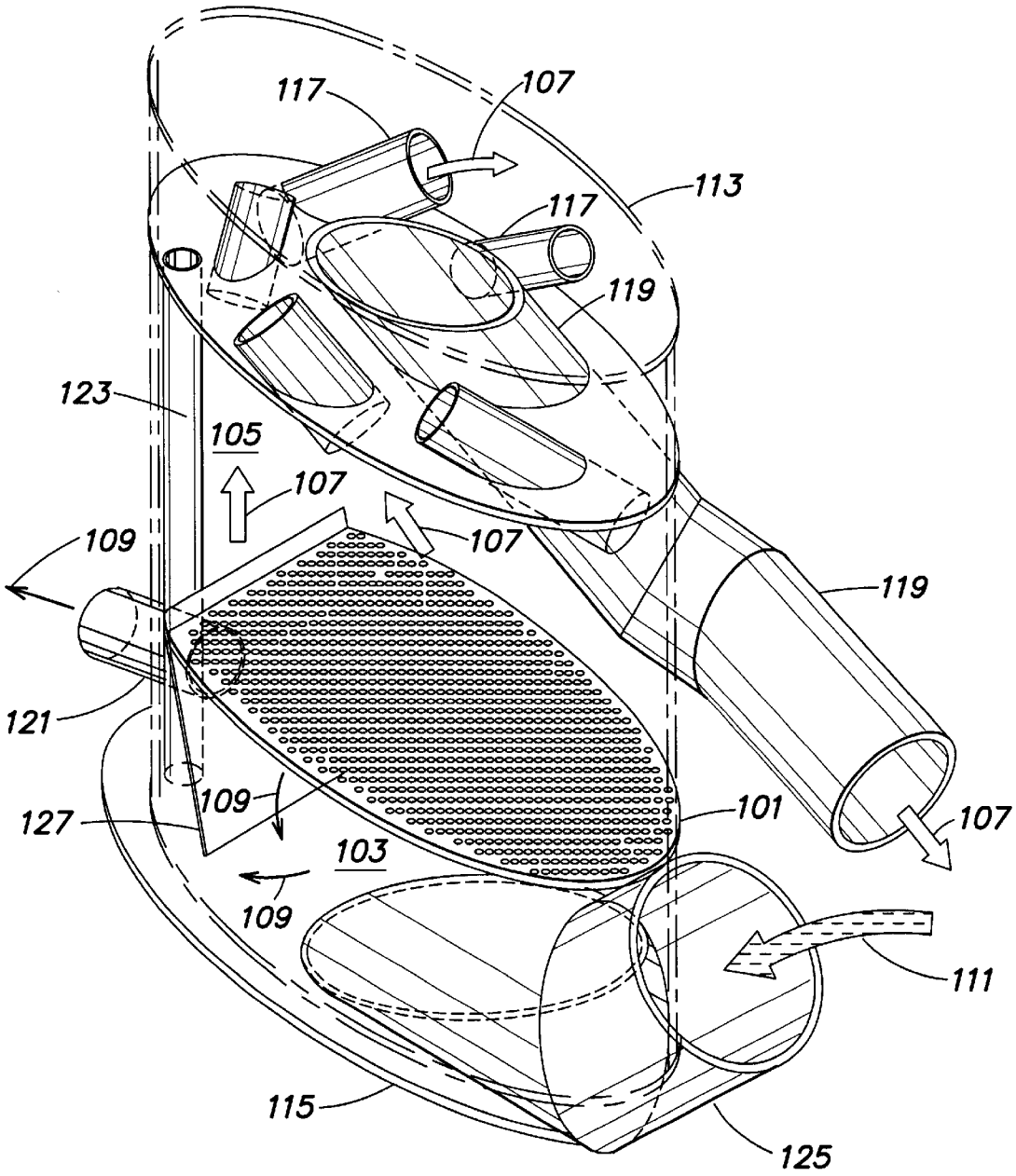
FIG. 1 (PRIOR ART)
FIG. 1 is a cut-away isometric view of a known silencer using a passive separation plate.

The detailed description below should be read in conjunction with the accompanying figures in which like reference numerals indicate like structures and method steps or acts. The examples included in the description are intended merely to be illustrative. The apparatus and method described are intended to be applicable to marine engine silencing systems such as might be used for quieting the engines of marine vessels or for quieting marine generators. The need for more effective marine engine silencers is broadly based. Pleasure and commercial craft operating on rivers, lakes, and near sea shores are a possible source of noise irritation to neighbors and other boaters; boat owners and users often desire the quietest possible environment for enjoying their avocation or pursuing their work; and marine generators may run for extended periods of time in proximity to workers or residents.

As already noted, the "cold, wet/dry" approach to marine engine noise attenuation offers superior results in terms of quieting, reducing the negative effects of back pressure on engine operation, and allowing compact and flexible silencer designs. The present invention employs a novel means of separating liquid coolant, typically water, from the exhaust gas to further realize these desired results. It will be understood that the term "dry gas" is used in this context throughout to refer to separation product that is predominantly, but not purely, exhaust gas. Complete separation generally is not practicable and it is to be anticipated that some liquid coolant will remain in the dry gas flow through discharge. Thus, the term "dry gas" should be understood to mean "consisting predominantly of exhaust gas," and references to "liquid coolant" as the product of the separation process should be understood to mean "consisting predominantly of liquid coolant," as some exhaust gas typically will remain.

Referring to FIG. 1, a prior art design is shown. A perforated baffle 101 is situated between a lower bubble chamber 103 and an upper dry gas chamber 105. Perforated baffle 101 may be referred to as a "passive-restraining separation" member because it relies primarily on gravity to separate dry gas 107 from liquid coolant 109. Specifically, perforated baffle 101 acts as a blanket to reduce vertical splashing and spray of fluid mixture 111, such as from lower bubble chamber 103 to upper dry gas chamber 105. Perforated baffle 101 thus acts simply to enhance gravitational separation of the heavier liquid coolant 109 from the lighter dry gas 107. Although some of liquid coolant 109 or fluid mixture 111, as well as dry gas 107, may pass upward through perforated baffle 101, the separation effect above perforated baffle 101 is similar to what would have been the case if there had been no baffle, that is, the heavier liquid component tends to be contained the lower chamber and the gas component tends to move toward the upper chamber. Thus, the vertical alignment of the lower and upper chambers of such prior art devices is an integral component. Also shown in FIG. 1, although not pertinent to the present description of the prior art device's passive restraining separation, are housing 113, attachment flange 115, resonator tubes 117, dry gas exhaust tube 119, liquid coolant discharge tube 121, secondary liquid coolant discharge tube 123, fluid mixture inlet tube 125, and baffle 127.

Figure 2:
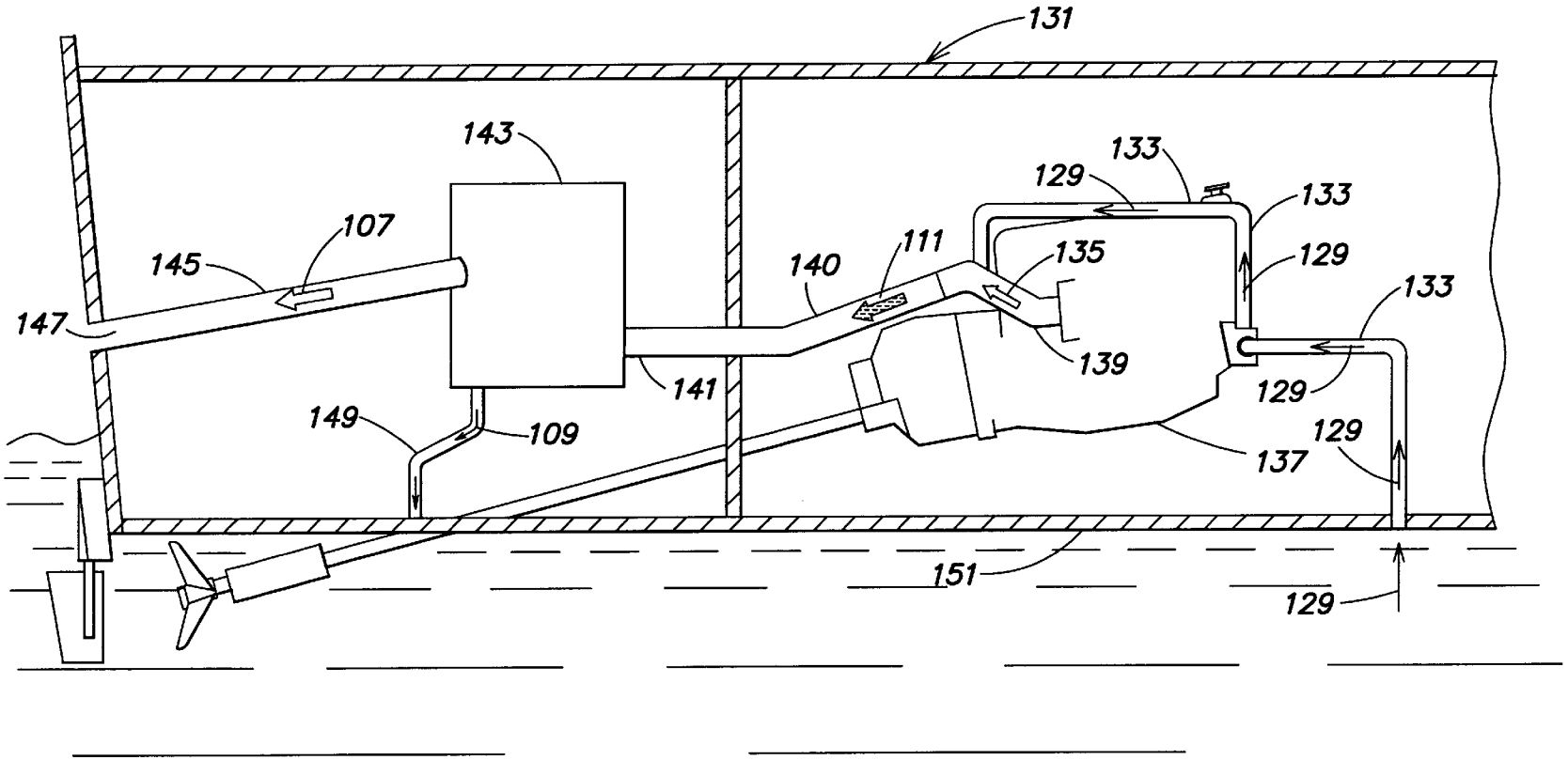
FIG. 2 is a schematic representation of one embodiment of the invention disposed within a marine vessel.

The invention will now be described in greater detail in reference to the exemplary implementations of water separating silencers with reference to FIGS. 2–7E. In one configuration, shown in FIG. 2, in which liquid coolant 129, typically obtained from the water in which vessel 131 is situated, is moved through a tube 133 for mixing with exhaust gas 135 exhausted by engine 137 through the exhaust manifold 139. In FIG. 2, the source of liquid coolant 129 is shown as engine raw water coolant, that is, water in which vessel 131 is situated and that is used for cooling the engine, either directly or through a heat exchanger. It will be understood that liquid coolant 129 may also be obtained directly from the water in which the vessel is situated, that is, without such water being used in the cooling of the engine. In any case, the resulting fluid mixture of cooled exhaust gas and liquid coolant (hereafter simply "fluid mixture") 111 moves through tube 140 to inlet 141 of silencer 143. The fluid mixture 111 is separated into dry gas and liquid coolant, and acoustic energy is removed from the dry gas and liquid coolant in the silencer, as described below. Dry gas 107 is then discharged from silencer 143 through exhaust tube 145, out exhaust port 147, and to the environment outside of vessel 131. Liquid coolant 109 is separately discharged through coolant discharge tube 149, out coolant outlet port 151, to the external environment. Exhaust tube 145 may be located so that the dry gas 107 is discharged below the water line instead of above the water line. Discharge tube 149 may be located so that the liquid coolant 109 is discharged above the water line instead of below the water line.

In some cases, however, such as in retrofitting an existing vessel (as contrasted with new boat construction), the configuration described above with respect to FIG. 2 may be undesireable because of the need to provide separate exhaust and coolant outlet ports 147 and 151, respectively, and associated tubing. An alternative design is thus to recombine the dry gas and the liquid coolant after acoustic energy has been extracted from the dry gas and liquid coolant, and to expel the re-combined exhaust gas and liquid coolant through a single exhaust port. This arrangement is referred to as a "wet-dry-wet" configuration. Though not shown, all elements are the same as just described with respect to FIG. 2, except that, in place of exhaust tubes 145 and 149, a single exhaust tube is provided to expel the re-combined dry gas and liquid coolant through an exhaust port above the water line. An alternative configuration may be provided in which the exhaust tube is directed so that the exhaust port is situated below the water line.

Figure 3:
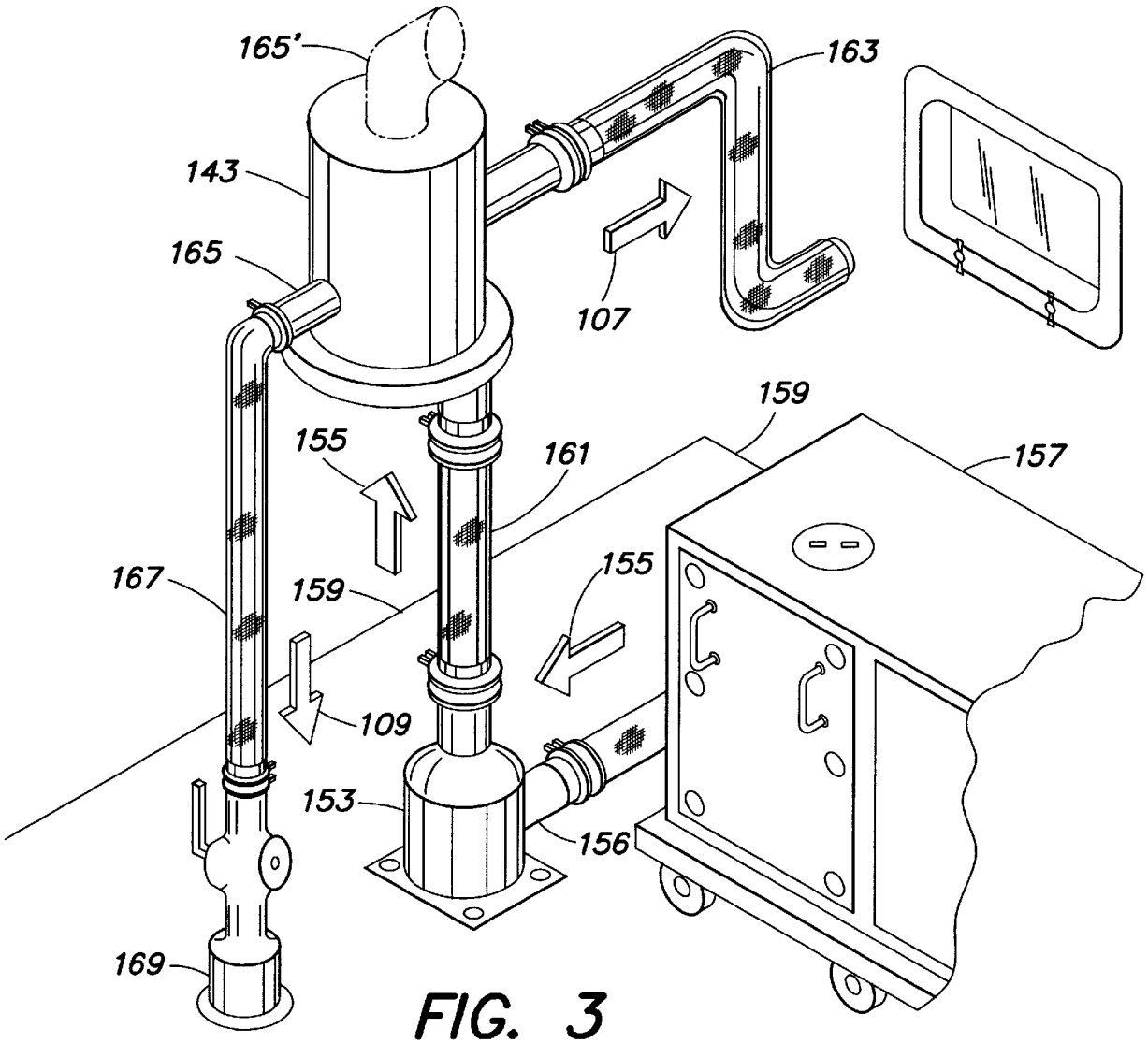
FIG. 3 is a schematic representation of another embodiment of the invention.

Referring to FIG. 3, a two-stage system is shown, combining a conventional waterlift silencer 153 with the water separator silencer 143 of the invention. Wet exhaust 155 exits from the generator 157 by a tube 156 and into the water lift silencer 153. The water lift silencer 153 may be located below the water line 159, as shown. From the water lift silencer 153, the wet exhaust 155 is directed into the water drop wet inlet 161 to the water separator silencer 143 according to the invention. The water separator silencer 143 is preferably disposed above the water line 159, as shown. From the water separator silencer 143, dry gas 107 exits via of the discharge 163. Liquid coolant 109 exits from the water separator silencer 143 by the outlet 165 to the raw water drain 167 and then to the sea cock 169 below water level 159. The outlet 165 for the liquid coolant 109 is shown as provided on the side of the water separator silencer 143, although the outlet 165 may be provided elsewhere. For example, the outlet 165' may be provided out of the top of the water separator silencer as shown in phantom in FIG. 3.

Figure 4A:
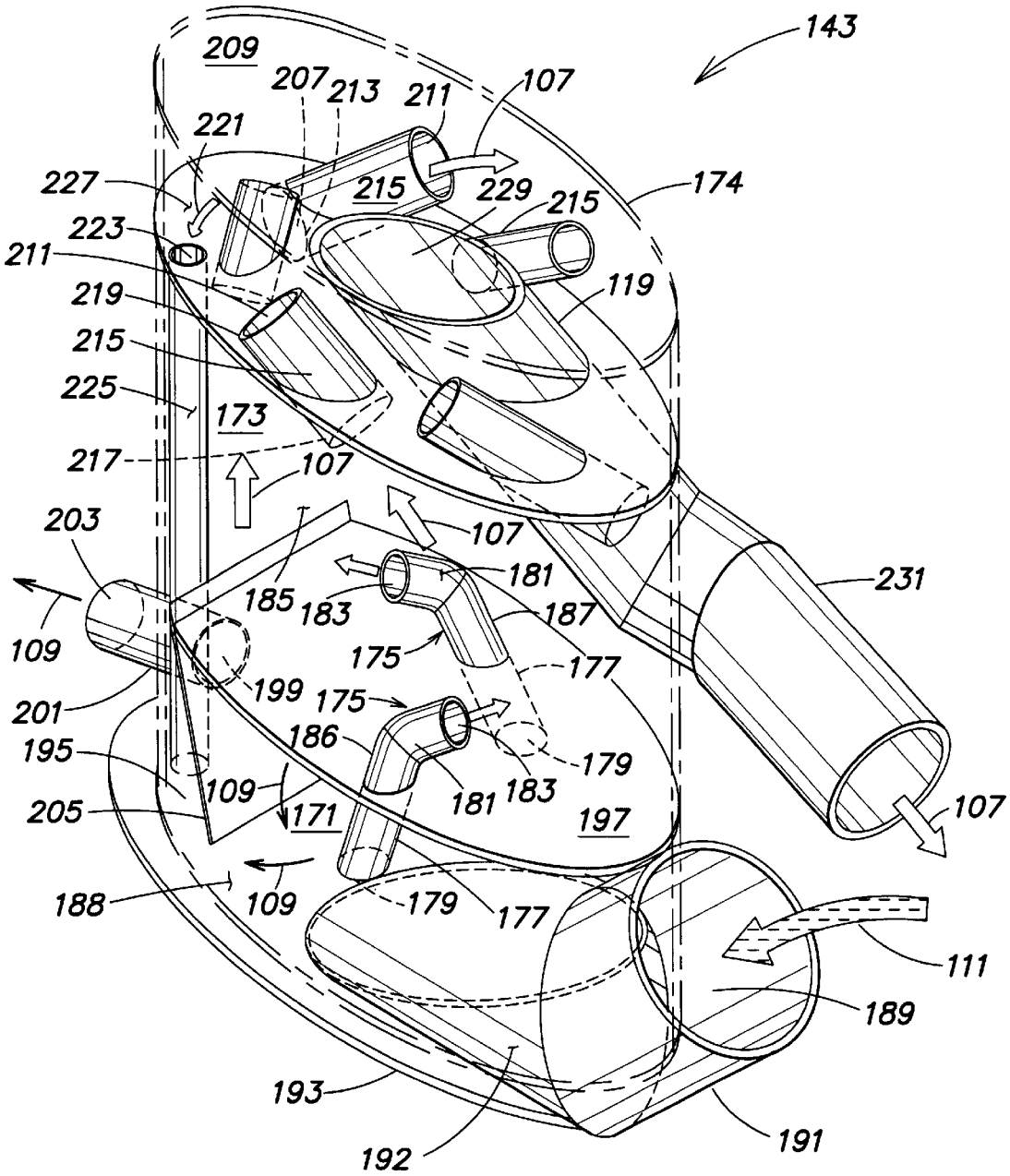
FIG. 4A is a cut-away isometric view of an embodiment of a silencer according to the invention.

Now with reference to FIG. 4A, a silencer 143 is shown that reduces the acoustic energy of a fluid mixture 111 of a liquid coolant and exhaust gas from an engine. A receiving chamber 171 of the silencer 143 receives the fluid mixture 111. The fluid mixture enters at least one lifting conduit 175 and then enters a separation chamber 173. The silencer may include a housing 174. The lifting conduit 175 has a receiving portion 177 with a first opening 179 and an expelling portion 181 with a second opening 183. The receiving portion 177 is fluidly coupled with the receiving chamber 171 so that the fluid mixture 111 enters the first opening 179 from the receiving chamber and is lifted through the lifting conduit 173 to the expelling portion 181. This lifting may be accomplished, at least in part, by dynamic effects. The separation chamber 173 is fluidly coupled with the second opening 183 of the lifting conduit, and has at least one interior surface 185. The expelling portion 181 of the lifting conduit 175 is disposed so that fluid mixture 111 expelled from the second opening is directed toward the at least one interior surface 185 of the separation chamber 173. The at least one interior surface may dynamically separate at least a portion of the dry gas 107 from the fluid mixture. This portion of the exhaust gas may be referred to as "dry gas." The dry gas typically includes some of the liquid coolant from the fluid mixture. Also, the liquid coolant 109 that is separated from the fluid mixture may include some exhaust gas. Thus, the separation of the fluid mixture 111 into dry gas 107 and liquid coolant 109 when the fluid mixture is expelled toward the interior surface 185 of the separation chamber 173 may not be a complete separation.

Dynamic separation may occur at least in part due to linear momentum effects. Additionally, the dynamic separation may occur at least in part due to centrifugal effects. Dynamic separation effects, in accordance with this invention, are to be contrasted with gravitational, passive-restraining, and other non-dynamic effects, a description of which is provided in U.S. Pat. No. 6,024,617, column 7, lines 38–51, referred to above and incorporated by reference herein.

The lifting conduit 175 may include a first discharge pipe 187, as shown in FIG. 4A, having a receiving portion 177 disposed within the receiving chamber 171 and having an expelling portion 181 disposed within the separation chamber 173. The expelling portion 181 may be configured and arranged to direct the fluid mixture as it is expelled with an angular momentum ("a first angular momentum"). When the fluid mixture contacts the interior surface 185 of the separation chamber, at least a portion of the exhaust gas is separated from the fluid mixture at least in part by a centrifugal effect. The angular momentum of the fluid mixture includes a directional component. For example, the fluid mixture may be swirled in a clockwise direction. The interior surface of the separation chamber may include a tubular lateral cross-section. For example, the interior wall of the separation chamber may be circular, or partially curved, so that when the fluid mixture 111 contacts the curved surface with an angular momentum, it swirls around the interior wall. In some implementations, the expelling portion of the lifting conduit may be further configured and arranged to direct the fluid mixture 111 as it is expelled with a downward momentum. Thus, the fluid mixture swirls around and down as it contacts the interior surface of the separation chamber. The liquid coolant, having greater mass density and inertia than the exhaust gas, tends to collect, condense, and fall by force of gravity toward the bottom of the separation chamber. The liquid coolant 109 then drains down into the liquid coolant receiving chamber. Similarly, any particulate matter retained within the fluid mixture, also having greater mass density and inertia than the exhaust gas, will tend to fall to the bottom of the separation chamber. Dry gas 107, having a smaller mass density and inertia, will tend to be redirected toward the inner region of the separation chamber and rise where it will exit through the resonator tubes into the expulsion chamber.

It will be understood that the lifting conduits 175 may take on a variety of forms. For example, the lifting conduit may include the discharge pipe 187. It will be further understood that the number and shape of the discharge pipes, their angle with respect to a bottom or first surface 197 of the separation chamber, the distance to which they extend above or below the bottom surface of the separation chamber, their shape or curvature above or below the bottom surface of the separation chamber, and their placement through the bottom surface of the separation chamber, may all be varied to optimize the described effect with respect to different geometries of the separation chamber, the anticipated range and nominal operation of engine speed, and other factors.

Figure 4B:
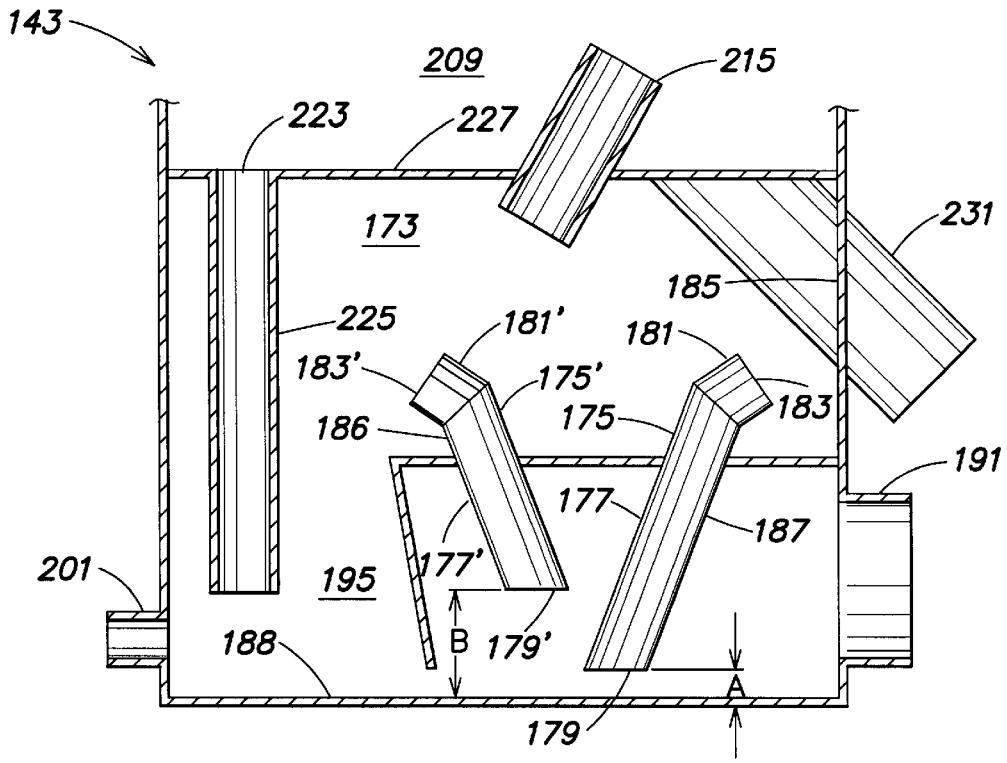
FIG. 4B is a cross-sectional view of another embodiment of a silencer according to the invention.
Figure 4C:
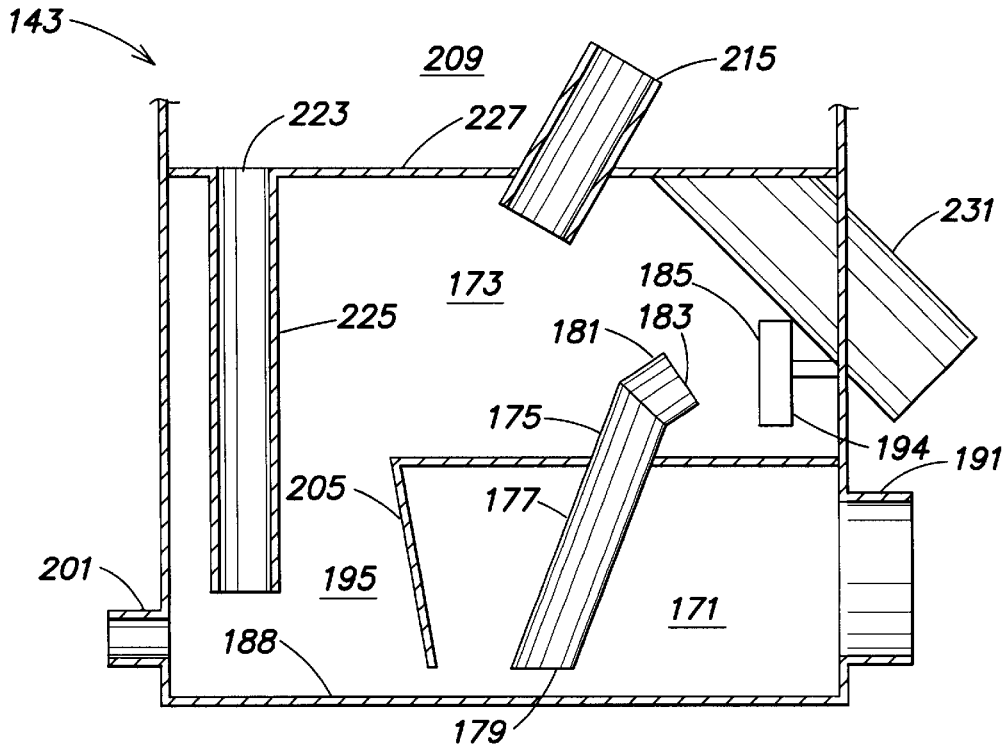
FIG. 4C is a cross-sectional view of another embodiment of a silencer according to the invention.

Additionally referring to FIG. 4B, the receiving portion 177 of the first discharge pipe 187 may include a first opening 179 disposed at a first height or distance A above a bottom or first surface 188 of the receiving chamber. A second lifting conduit 175' includes a second discharge pipe 186. This second discharge pipe 186 has a receiving portion 177' disposed within the receiving chamber 171 and has an expelling portion 181' with a second opening 183' disposed within the separation chamber 173 so that the expelling portion is configured and arranged to direct the fluid mixture 111 as it is expelled with an angular momentum. When the fluid mixture 111 contacts the interior surface 185 of the separation chamber, at least a portion of the exhaust gas is separated from the fluid mixture at least in part by a centrifugal effect. The receiving portion of the second discharge pipe includes a first opening 179' disposed at a second height or distance B above the bottom surface 188 of the receiving chamber. As shown in FIG. 4B, the first height or distance A may not necessarily be the same height or distance as the second height or distance B. The first discharge pipe 187 may be dynamically operative for lifting the fluid mixture when the fluid mixture has a free-surface height or distance above the bottom surface 188 of the receiving chamber that is within a first range of heights or distances. The second discharge pipe 186 may be dynamically operative for lifting the fluid mixture when the fluid mixture has a free-surface height or distance above the bottom surface 188 of the receiving chamber that is within a second range of heights or distances including a threshold height or distance above which the second discharge pipe is not dynamically operative. Some other aspects of dynamic operation of the dual or multiple discharge pipes are described in U.S. patent application Ser. No. 09/349,871, referred to above and incorporated by reference herein.

As shown in FIG. 4A, the interior surface 185 may be a wall of the separation chamber. However, referring to FIG. 4C, the silencer 143 is shown having a separate interior surface 185 provided on an extending member 194. The extending member 194 may extend from the top, bottom or side surface of the separation chamber. An extending member 194 may be provided for each discharge tube 187. Moreover, both the wall of the separation chamber and extending members may be used in conjunction with each other. The interior surface on the wall or extending member may have any desired size or shape including various curvatures. The interior surface may also be formed of any suitable material, including materials having various textures, or a varied or veined surface having projections to catch the liquid coolant and allow the liquid coolant to run off the surface. The interior surface made be made of metal or plastic or another other suitable material.

The receiving chamber may have a fluid mixture inlet port 189. The silencer 143 includes at least one fluid mixture inlet tube 191 having a discharge end 192 fluidly coupled to the fluid mixture inlet port 189 and through which the fluid mixture 111 is received into the receiving chamber. The silencer may also include an attachment flange 193 for attaching the silencer to a surface.

As shown in FIG. 4A, the separation chamber 173 may be located adjacent a liquid coolant receiving chamber 195, such that the liquid flows off the bottom surface 197 of the separation chamber and into the liquid coolant receiving chamber 195. A baffle 205 separates the receiving chamber 171 from the liquid coolant receiving chamber 195. A fraction of the liquid coolant 109 may flow underneath the baffle 205. The liquid coolant receiving chamber includes at least one liquid coolant discharge port 199. The silencer 143 may include at least one liquid coolant discharge conduit 201 having the liquid coolant discharge port 199 fluidly coupled between the liquid coolant discharge port 199 and the discharge exit 203 such that the liquid coolant 109 is discharged from the liquid coolant receiving chamber 195.

The separation chamber may have at least one exhaust gas discharge port 207 through which dry gas 107 is discharged from the separation chamber. The silencer may have an expulsion chamber 209 having at least one exhaust gas inlet port 211, each gaseously coupled to an exhaust gas discharge port 213 of the separation chamber. At least one exhaust gas inlet port 211 of the expulsion chamber and at least one exhaust gas discharge port 213 of the separation chamber may comprise the same port. The silencer may also have one or more resonator tubes 215. Each of the tubes has a bottom portion 217 disposed within the separation chamber through an exhaust gas discharge port 213 of the separation chamber, and also has a top portion 219 disposed within the expulsion chamber 209 through an exhaust gas inlet port 211 of the expulsion chamber. The dry gas 107 is discharged from the separation chamber, through the one or more resonator tubes 215, into the expulsion chamber 209. Resonator tubes 215 may be cylindrical, having a circular cross section. It will be understood that resonator 215 need not have such a shape, but could, for example, be a generally hollow body having as a cross section at any point along the longitudinal axis thereof any one, or a combination, of shapes of constant or varying size.

In some implementations, such as shown in FIG. 4A, the top portions 219 of the resonator tubes are configured and arranged to direct the dry gas 107 that is discharged through resonators 215 into the expulsion chamber with angular momentum ("a second angular momentum"). The second angular momentum may be based at least in part on a directional component opposite to that of a directional component on which the first angular momentum, discussed above, is based at least in part. For example, the resonator tubes 215 may be oriented to direct the dry gas 107 with a swirling motion when it enters the expulsion chamber 209, and this swirling motion is opposite to the swirling motion that expelling portion of the discharge pipe directed to the fluid mixture 111 when it entered the separation chamber.

The top portion 219 of the resonator tube 215 may be disposed so that the dry gas discharged is directed toward an interior surface of the expulsion chamber. As noted, because prior separation typically may not be complete, the dry gas 107 discharged through the first resonator tube 215 may include residual liquid coolant 221. Additional separation of the residual liquid coolant 221 from the dry gas 107 may be achieved due to centrifugal effects when the dry gas 107 discharged from the resonator tube swirls around the expulsion chamber 209. The expulsion chamber may have a curved surface to facilitate this swirling and centrifugal separation. The residual liquid coolant 221, having a greater mass density and inertia than the exhaust gas component of the dry gas 107, tends to spin to the surfaces of the expulsion chamber 209. The liquid coolant will tend to collect, condense, and fall by force of gravity toward the bottom of expulsion chamber 209. This residual liquid coolant 221 may exit into the liquid coolant receiving chamber through a liquid coolant entrance port 223 fluidly coupled a residual liquid coolant discharge tube 225 provided through bottom surface 227 of the expulsion chamber 209. The residual liquid coolant 221 then flows into the liquid coolant receiving chamber 195 to exit through liquid coolant discharge conduit 201. Particulate matter retained within dry gas 107, also having a greater mass density and inertia than the dry gas, will tend to fall to the bottom of the expulsion chamber 209. Dry gas 207 having a smaller mass density and inertia than residual liquid coolant 221, will tend to be redirected toward the inner region of the expulsion chamber where it will exit through a dry gas entrance port 229 gaseously connected to dry gas exhaust tube 231 to expel the dry gas 107 from the silencer 143. It will also be understood that it is possible to have no expulsion chamber so that dry gas 107 exits through the resonator tube 215, or exits directly through dry gas exhaust tube 231, if no resonator tube is employed.

Figure 5A:
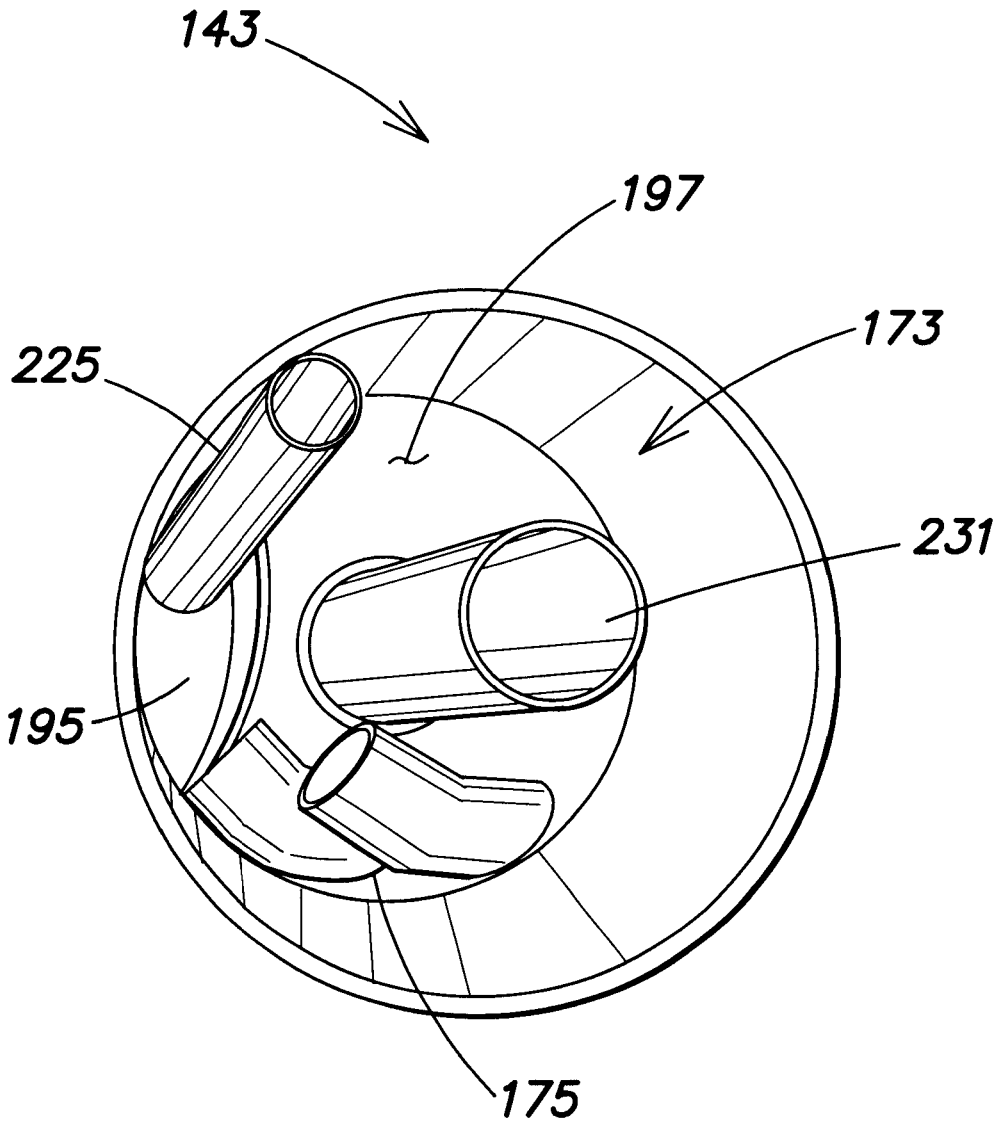
FIG. 5A is a top perspective view of another embodiment of a silencer according to the invention during assembly.
Figure 5C:
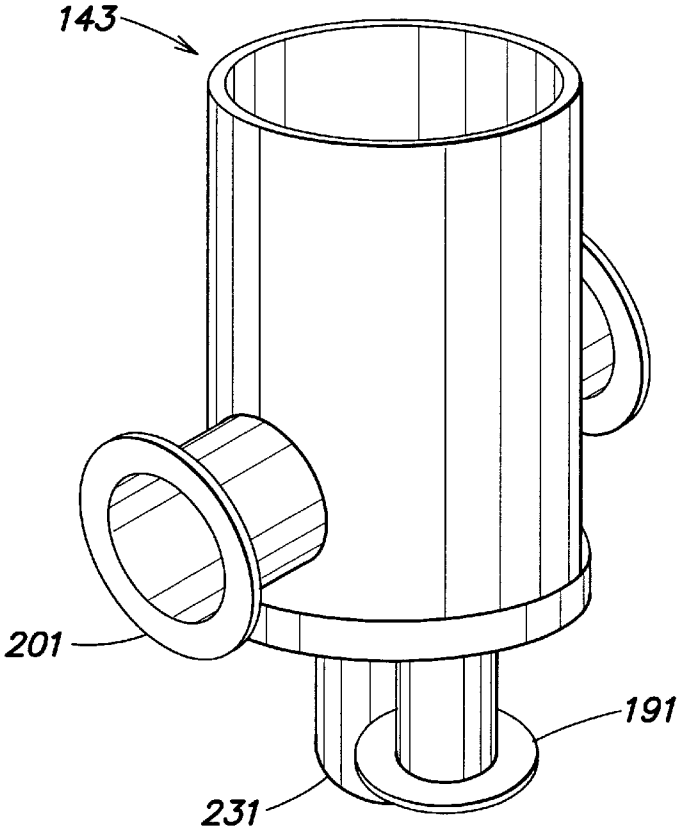
FIG. 5C is a side view of the embodiment of FIG. 5A according to the invention.
Figure 5B:
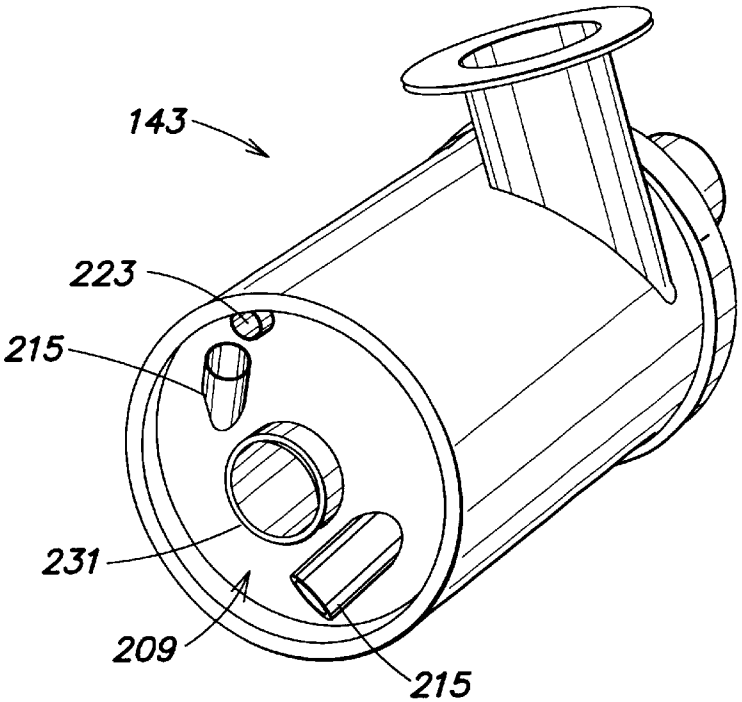
FIG. 5B is a top perspective view of the embodiment of FIG. 5A according to the invention during assembly.

FIG. 5A shows the silencer 143 according to the invention partially assembled. The separation chamber 173 is shown with the lifting conduits 175 extending from the bottom surface 197 of the separation chamber. Additionally, the liquid coolant receiving chamber 195 and residual liquid coolant discharge tube 225 are shown. The dry gas exhaust tube 231 is provided through the center of the separation chamber 173. FIG. 5B, shows the silencer of FIG. 5A further along in the assembly process; the expulsion chamber 209 is viewed from above. Resonator tubes 215 are provided through the bottom surface of the expulsion chamber. The liquid coolant entrance port 223 to the residual liquid coolant discharge tube 225 is also visible. The dry gas exhaust tube 231 is also provided through the center of the expulsion chamber into the separation chamber. Finally, FIG. 5C shows the silencer of FIG. 5A from the side view. The liquid coolant discharge conduit 201 is shown extending from the side of the silencer, while the fluid mixture inlet tube 191 and the dry gas exhaust tube 231 are provided extending from the bottom of the silencer 143.

Figure 6A:
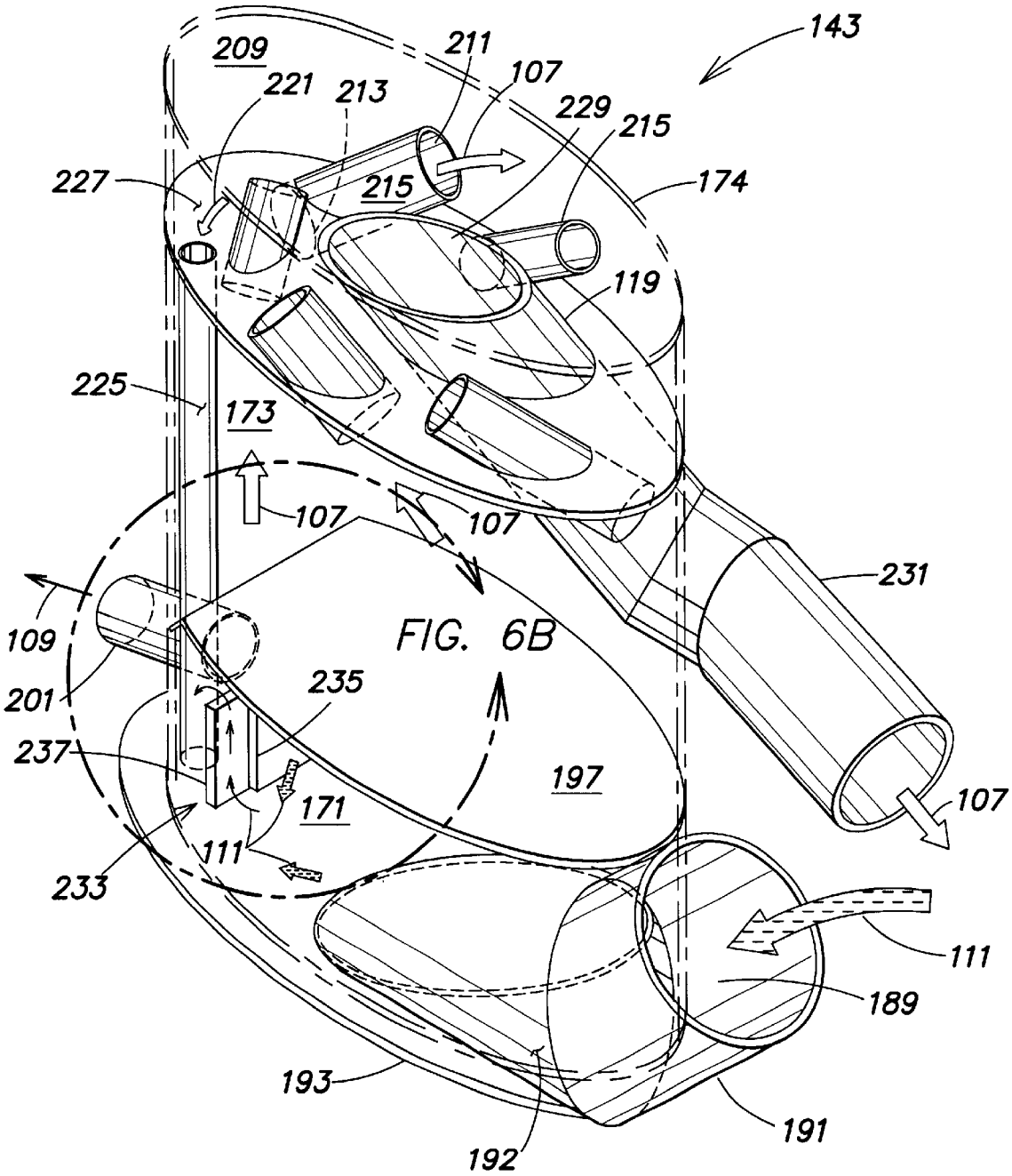
FIG. 6A is a cut-away isometric view of an embodiment of the invention including a dam.
Figure 6B:
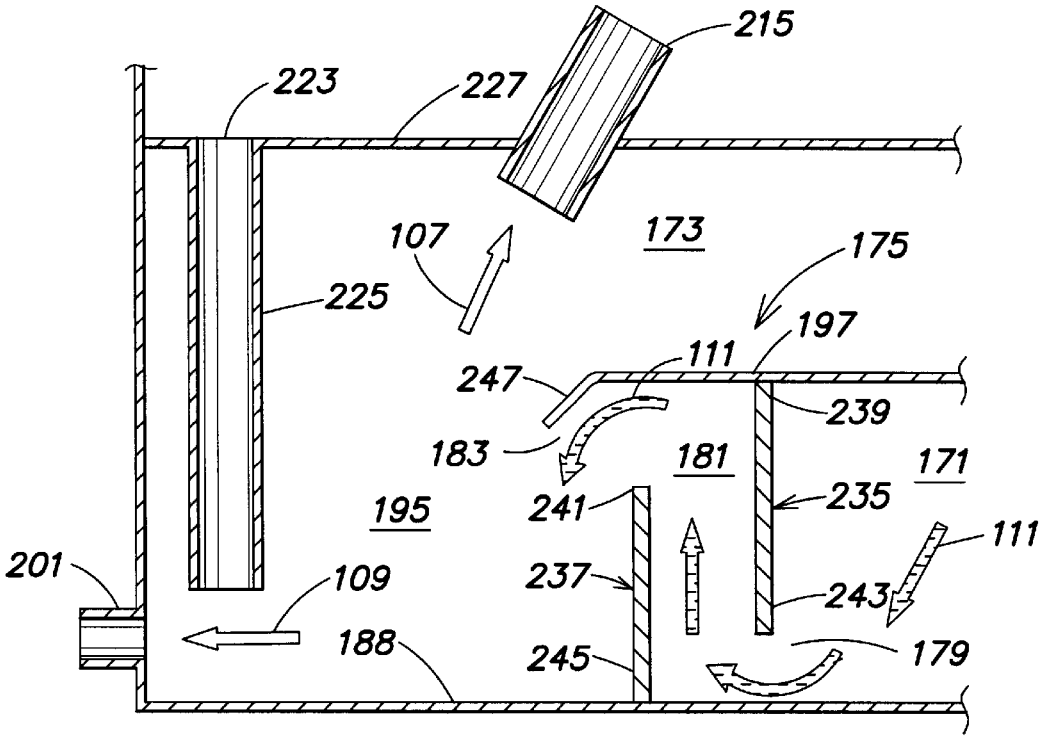
FIG. 6B is a cross-sectional side view of the dam of FIG. 6A.

Alternatively, in another embodiment, the lifting conduit 175 of the silencer 143 includes a dam. Referring to FIG. 6A, the lifting conduit 175 of a silencer 143 is shown including a dam 233. The dam 233 includes a receiving side 235 and expelling side 237 of the dam. Each side has top or first portions 239 and 241 and bottom or second portions 243 and 245. As shown in FIG. 6B, the dam also has a directing member 247 generally disposed across the top of the dam. For example, as shown in FIG. 6B, the directing member 247 may be disposed adjacent to the top portion 239 of the receiving side 235 so that the expelling portion 181 of the lifting conduit 175 includes the top portions 239 and 241 of the receiving and expelling sides 235 and 237 and the directing member 247. The first opening 179 of the lifting conduit 175 is disposed adjacent the bottom portion 243 of the receiving side 235, and the second opening 183 of the lifting conduit 175 is disposed adjacent the top portion 245 of the expelling side 237. The separation chamber 173 has a bottom interior surface, and, in some implementations as shown, the directing member 247 is disposed so that the fluid mixture expelled through the second opening 183 is directed at least partially downward toward the bottom interior surface 188 of the liquid coolant receiving chamber 195, as shown in FIG. 6B. The fluid mixture flows under the bottom portion of the receiving side 135 of the dam and then up and over the top portion of the expelling side 137 of the dam into the liquid coolant receiving chamber 195. The liquid coolant 109 accumulated in the liquid coolant receiving chamber 195 is expelled out through the liquid coolant discharge tube 201. The dam 233 may be combined with other types of silencers, such as those shown in FIGS. 1 and 4A–C.

Figure 7A:
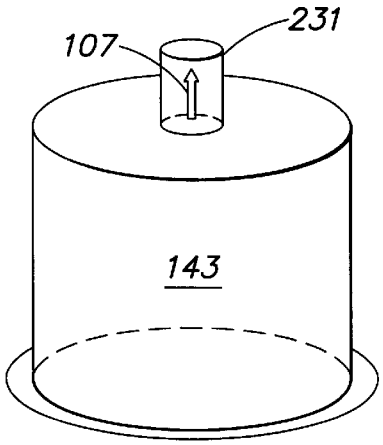
FIG. 7A is a side view of an embodiment of the pipe locations for a dry gas exhaust tube for a silencer according to the invention.
Figure 7B:
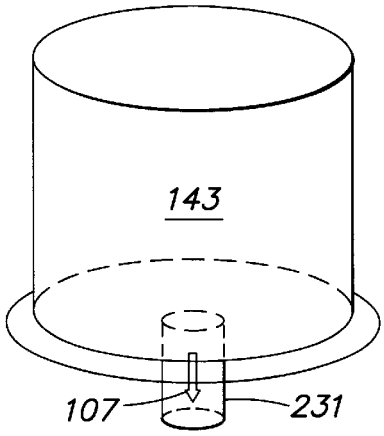
FIG. 7B is a side view of an embodiment of the pipe locations for a dry gas exhaust tube for a silencer according to the invention.
Figure 7C:
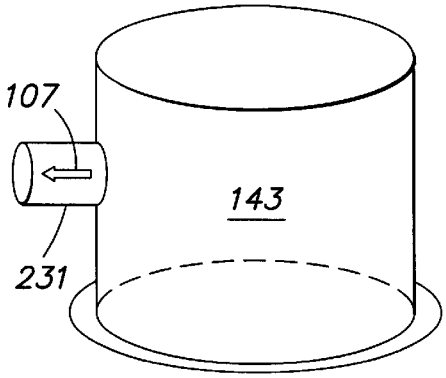
FIG. 7C is a side view of an embodiment of the pipe locations for a dry gas exhaust tube for a silencer according to the invention.
Figure 7D:
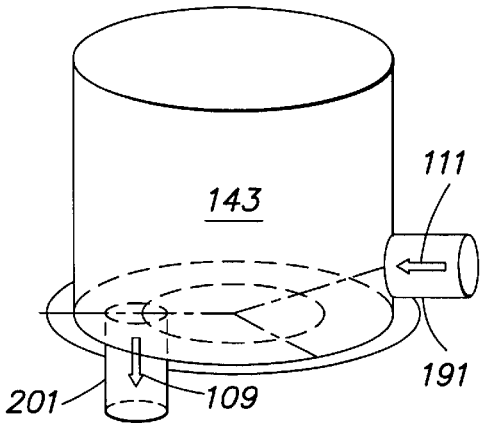
FIG. 7D is a side view of an embodiment of the pipe locations for a fluid mixture inlet tube and a liquid coolant discharge conduit for a silencer according to the invention.
Figure 7E:
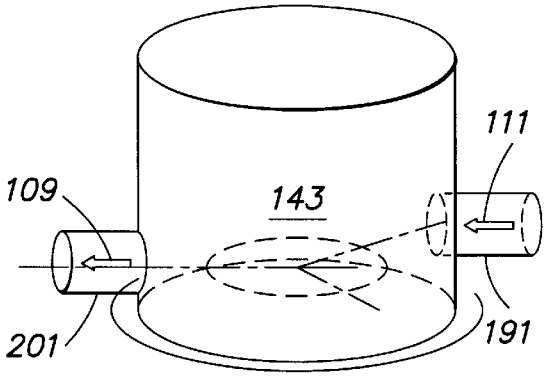
FIG. 7E is a side view of an embodiment of the pipe locations for a fluid mixture inlet tube and a liquid coolant discharge conduit for a silencer according to the invention.

Referring to FIGS. 7A–E, various pipe attachment options are shown for the water separator silencer 143 of the present invention. FIGS. 7A–C show several positions available for the dry gas exhaust tube 231 from the silencer 143. As shown in FIGS. 7A and B, the dry gas 107 may exit from either the top or bottom of the silencer. Additionally, FIG. 7C shows the dry gas exiting from the side of the silencer. The dry gas exhaust tube 231 may be provided anywhere on the side of the silencer and at any desired angle. FIGS. 7D–E show various pipe positions for the liquid coolant discharge conduit 201. FIG. 7D shows the liquid coolant 109 discharging from the bottom of the silencer 143, and FIG. 7E shows the liquid coolant 109 discharging from the side of the silencer 143. The fluid mixture inlet tube 191 is also shown. If the liquid coolant discharge conduit is provided on the side of the silencer, preferably the discharge conduit is located no less than about 45° from the fluid mixture inlet tube 191 axis.

In another aspect, a method is disclosed for reducing the acoustic energy of a fluid mixture of a liquid coolant and of exhaust gas from an engine. The method includes the steps of: receiving the fluid mixture in a receiving chamber; lifting the fluid mixture through a lifting conduit; and expelling the lifted fluid mixture toward an interior surface of the separation chamber. The method may also include the further step, when the fluid mixture contacts the interior surface, of dynamically separating at least a portion of the exhaust gas from the fluid mixture. The dynamically separating step may include dynamically separating by a linear momentum effect or by a centrifugal effect. Additionally, the lifting step may include dynamic lifting.

In this method, the lifting conduit may include a discharge pipe having a receiving portion disposed within the receiving chamber and having an expelling portion disposed within the separation chamber. The expelling step may include directing the fluid mixture as it is expelled with an angular momentum, such as a first angular momentum. The expelling step may further include directing the fluid mixture as it is expelled with a downward momentum. Another step may be that of discharging the dry gas through one or more resonator tubes into an expulsion chamber. This step may include directing the dry gas discharged through it into the expulsion chamber with a second angular momentum. The step of dynamically separating at least a portion of the exhaust gas from the fluid mixture may include the step of directing the fluid mixture with a first angular momentum. The second angular momentum may be based at least in part on a directional component opposite to that of a directional component on which the first angular momentum is based at least in part. For example, the swirling may be in opposite directions as discussed above.

In some aspects of the method, the lifting conduit includes a dam having generally opposing receiving and expelling sides each having top and bottom portions. The dam also has a directing member generally transverse with the receiving and expelling sides and disposed adjacent to the top portion of the receiving side. In these aspects of the method, the expelling step may include the step of expelling the fluid mixture through an expelling portion of the dam comprising the bottom portion of the receiving side and the top portion of the expelling side and the directing member. In some implementations of the method, the liquid coolant receiving chamber has a bottom interior surface. The expelling step in these implementations further includes the step of expelling the fluid mixture through the expelling portion of the dam so that the fluid mixture is directed downward toward the bottom interior surface of the liquid coolant receiving chamber.

Having now described some embodiments of the invention, it should be apparent to those skilled in the art that the foregoing embodiments are illustrative only and not limiting, having been presented by way of example only. Numerous other embodiments and modifications thereof are contemplated as falling within the scope of the present invention as defined by the appended claims and equivalents thereto. By way of example and not limitation, the size shape and number of chambers may be changed so that, for instance, in one variation the separation chamber is shrunk to allow for greater centrifugal effects of separation. Any suitable number, size, shape and placement of the lifting tubes 175 may be employed to extract acoustic energy from the fluid mixture. Additionally, the interior surface may take on any number of different configurations. Also, additional chambers (not shown) may be added after separation chamber 173 such chambers being connected for transporting dry gas 107 or liquid coolant 109 through openings in their adjoining walls, or by a series of connectors, or both. Such additional chambers may be configured either in-line or otherwise, vertically or otherwise, to provide opportunities for further extracting liquid coolant 109 and acoustic energy from dry gas 107. The size shape or placement of resonator tube 215 employed may be varied; supplemental resonator tubes, with or without perforations, may be added. The expulsion chamber may be varied in size, shape or placement; and various means for expelling the dry gas and liquid coolant, or the recombined fluid mixture, may be employed.

The aspects and implementations of the present invention described above are not necessarily inclusive or exclusive of each other and may be combined in any manner that is non-conflicting and otherwise possible, whether they be presented in association with a same, or a different, aspect or implementation of the invention. The description of one aspect is not intended to be limiting with respect to other aspects. In addition, any one or more function, step, operation, or technique described elsewhere in this specification may, in alternative aspects, be combined with any one or more function, step, operation, or technique described in the summary. Thus, the above aspects are illustrative rather than limiting.

We claim:

1. A silencer for reducing the acoustic energy of a fluid mixture of a liquid coolant and of exhaust gas from an engine, comprising:

a receiving chamber that receives a fluid mixture;

at least one lifting conduit having a receiving portion including a first opening and having an expelling portion including a second opening, the receiving portion being fluidly coupled with the receiving chamber so that substantially all the fluid mixture enters the first opening from the receiving chamber and is lifted through the lifting conduit to the expelling portion; and a separation chamber fluidly coupled with the second opening and having at least one interior surface, wherein the expelling portion is disposed so that the fluid mixture is directed toward the at least one interior surface and expelled from the second opening into the separation chamber, which is adapted to substantially separate the fluid mixture into liquid coolant and exhaust gas components.

2. The silencer of claim 1, wherein:

the at least one interior surface includes an extending member.

3. The silencer of claim 1, wherein:

the at least one interior surface is configured and arranged to dynamically separate at least a portion of the exhaust gas from the fluid mixture.

4. The silencer of claim 3, wherein:

the at least one interior surface is configured and arranged to dynamically separate the at least a portion of the exhaust gas at least in part by a linear momentum effect.

5. The silencer of claim 3, wherein:

the at least one interior surface is configured and arranged to dynamically separate the at least a portion of the exhaust gas at least in part by a centrifugal effect.

6. The silencer of claim 1, wherein:

a first of the at least one lifting conduits comprises a first discharge pipe having a receiving portion disposed within the receiving chamber and having an expelling portion disposed within the separation chamber, the expelling portion configured and arranged to direct the fluid mixture with an angular momentum as it is expelled and, when the fluid mixture contacts the at least one interior surface of the separation chamber, at least a portion of the exhaust gas is separated from the fluid mixture at least in part by a centrifugal effect.

7. The silencer of claim 6, wherein:

the at least one interior surface of the separation chamber comprises a tubular lateral cross section.

8. The silencer of claim 6, wherein:

the expelling portion further directs the fluid mixture with a downward momentum as it is expelled.

9. The silencer of claim 6, wherein:

the receiving chamber has a first surface;

the receiving portion of the first discharge pipe includes an opening disposed at a first distance from the first surface of the receiving chamber;

a second of the at least one lifting conduit comprises a second discharge pipe having a receiving portion disposed within the receiving chamber and having an expelling portion disposed within the separation chamber configured and arranged to direct the fluid mixture with an angular momentum as it is expelled and, when the fluid mixture contacts the at least one interior surface of the separation chamber, at least a portion of the exhaust gas is separated from the fluid mixture at least in part by a centrifugal effect, wherein the receiving portion of the second discharge pipe includes an opening disposed at a second distance from the first surface of the receiving chamber.

10. The silencer of claim 9, wherein:

the first distance is not the same distance as the second distance.

11. The silencer of claim 9, wherein:

the first discharge pipe is dynamically operative for lifting the fluid mixture when the fluid mixture has a free-surface distance above the first surface of the receiving chamber that is within a first range of distances, and the second discharge pipe is dynamically operative for lifting the fluid mixture when the fluid mixture has a free-surface distance above the first surface of the receiving chamber that is within a second range of distances including a threshold distance above which the second discharge pipe is not dynamically operative.

12. The silencer of claim 1, wherein:

the receiving chamber includes a fluid mixture inlet port; and the silencer further comprises at least one inlet conduit having a discharge end fluidly coupled to the fluid mixture inlet port and through which the fluid mixture is received into the receiving chamber.

13. The silencer of claim 1, wherein:

the separation chamber includes at least one liquid coolant discharge port; and the silencer further comprises at least one liquid coolant discharge conduit, each having a receiving end fluidly coupled to a liquid coolant discharge port and through which the liquid coolant is discharged from the separation chamber.

14. The silencer of claim 13, wherein:

the separation chamber includes a liquid coolant receiving chamber fluidly coupled to the liquid coolant discharge port.

15. The silencer of claim 1, wherein:

the separation chamber includes at least one exhaust gas discharge port through which the at least a portion of the exhaust gas is discharged from the separation chamber.

16. The silencer of claim 15, further comprising:

an expulsion chamber having at least one exhaust gas inlet port, each gaseously coupled to an exhaust gas discharge port of the separation chamber.

17. The silencer of claim 16, wherein:

at least one of the at least one exhaust gas inlet port of the expulsion chamber and at least one of the at least one exhaust gas discharge port of the separation chamber comprise a same port.

18. The silencer of claim 16, further comprising:

one or more resonator tubes, each having a first portion disposed within the separation chamber through an exhaust gas discharge port of the separation chamber and having a second portion disposed within the expulsion chamber through an exhaust gas inlet port of the expulsion chamber, wherein at least a portion of the exhaust gas is discharged from the separation chamber, through the one or more resonator tubes, into the expulsion chamber.

19. The silencer of claim 18, wherein:

the second portion of at least a first of the one or more resonator tubes is configured and arranged to direct the exhaust gas discharged through it into the expulsion chamber with a first angular momentum.

20. The silencer of claim 19, wherein:

a first of the at least one lifting conduit comprises a first discharge pipe having a receiving portion disposed within the receiving chamber and having an expelling portion disposed within the separation chamber and configured and arranged to direct the fluid mixture with a second angular momentum as it is expelled and, when the fluid mixture contacts the at least one interior surface of the separation chamber, at least a portion of the exhaust gas is separated from the fluid mixture at least in part by a centrifugal effect; and the second angular momentum is based at least in part on a directional component opposite to that of a directional component on which the first angular momentum is based at least in part.

21. The silencer of claim 19, wherein:

the expulsion chamber includes at least one interior surface; and the first portion of the first resonator tube is further disposed so that the exhaust gas discharged through it is directed toward the at least one interior surface of the expulsion chamber.

22. The silencer of claim 21, wherein:

the exhaust gas discharged through the first resonator tube includes residual liquid coolant; and the at least one interior surface of the expulsion chamber dynamically separates the residual liquid coolant from the exhaust gas at least in part by a centrifugal effect.

23. A silencer for reducing the acoustic energy of a fluid mixture of a liquid coolant and of exhaust gas from an engine, comprising:

a receiving chamber that receives a fluid mixture;

at least one lifting conduit having a receiving portion including a first opening and having an expelling portion including a second opening, the receiving portion being fluidly coupled with the receiving chamber so that the fluid mixture enters the first opening from the receiving chamber and is lifted through the lifting conduit to the expelling portion;

a separation chamber fluidly coupled with the second opening and having at least one interior surface, wherein the expelling portion is disposed so that the fluid mixture expelled from the second opening is directed toward the at least one interior surface; and the lifting conduit comprises a dam having generally opposing receiving and expelling sides each having first and second portions, the lifting conduit further comprising a directing member generally transverse with the receiving and expelling sides and disposed adjacent to the first portion of the receiving side, wherein the expelling portion comprises the first portions of the receiving and expelling sides and the directing member, the first opening is disposed adjacent the second portion of the receiving side, and the second opening is disposed adjacent the first portion of the expelling side.

24. The silencer of claim 23, wherein:

the separation chamber has a bottom interior surface, and the directing member is disposed so that the fluid mixture expelled through the second opening is directed at least partially downward toward the bottom interior surface of the separation chamber.

25. The silencer of claim 24 wherein:

the separation chamber includes a liquid coolant receiving chamber.

26. A method for reducing the acoustic energy of a fluid mixture of a liquid coolant and of exhaust gas from an engine, comprising the steps of:

receiving the fluid mixture in a receiving chamber;

lifting substantially all the fluid mixture through a lifting conduit;

expelling the lifted fluid mixture toward an interior surface of a separation chamber, the separation chamber being adapted to substantially separate the fluid mixture into liquid coolant and exhaust gas components.

27. The method of claim 26, further comprising the step of:

when the fluid mixture contacts the interior surface, dynamically separating at least a portion of the exhaust gas from the fluid mixture.

28. The method of claim 27, wherein:

the dynamically separating step includes dynamically separating by a linear momentum effect.

29. The method of claim 27, wherein:

the dynamically separating step includes dynamically separating by a centrifugal effect.

30. The method of claim 26, wherein:

the lifting step includes dynamic lifting.

31. The method of claim 26, wherein:

the lifting conduit comprises at least one discharge pipe having a receiving portion disposed within the receiving chamber and having an expelling portion disposed within the separation chamber; and the expelling step includes directing the fluid mixture as it is expelled with an angular momentum.

32. The method of claim 31, wherein:

the expelling step further includes directing the fluid mixture as it is expelled with a downward momentum.

33. The method of claim 27, further comprising:

discharging the exhaust gas through one or more resonator tubes into an expulsion chamber.

34. The method of claim 33, wherein:

the discharging the exhaust gas step includes the step of directing the exhaust gas discharged through it into the expulsion chamber with a first angular momentum.

35. The method of claim 34, wherein:

the step of dynamically separating at least a portion of the exhaust gas from the fluid mixture includes the step of directing the fluid mixture with a second angular momentum; and the second angular momentum is based at least in part on a directional component opposite to that of a directional component on which the first angular momentum is based at least in part.

36. A method for reducing the acoustic energy of a fluid mixture of a liquid coolant and of exhaust gas from an engine, comprising the steps of:

receiving the fluid mixture in a receiving chamber;

lifting the fluid mixture through a lifting conduit;

expelling the lifted fluid mixture toward an interior surface of a separation chamber;

the lifting conduit comprises a dam having generally opposing receiving and expelling sides each having first and second portions, the lifting conduit further comprising a directing member generally transverse with the receiving and expelling sides and disposed adjacent to the first portion of the receiving side; and the expelling step includes the step of expelling the fluid mixture through an expelling portion of the dam comprising the first portions of the receiving and expelling sides and the directing member.

37. The method of claim 36, wherein:

the separation chamber has a bottom interior surface, and the expelling step further includes the step of expelling the fluid mixture through the expelling portion of the dam so that the fluid mixture is directed downward toward the bottom interior surface of the separation chamber.

38. The method of claim 37, wherein:

the separation chamber includes a liquid coolant receiving chamber having a bottom interior surface, and the expelling step further includes the step of expelling the fluid mixture through the expelling portion of the dam so that the fluid mixture is directed downward toward the bottom interior surface of the liquid coolant receiving chamber.

39. A silencer for reducing the acoustic energy of a fluid mixture of a liquid coolant and of exhaust gas from an engine, comprising:

a receiving chamber that receives the fluid mixture;

at least one lifting conduit having a receiving portion including a first opening and having an expelling portion including a second opening, the receiving portion being fluidly coupled with the receiving chamber so that the fluid mixture enters the first opening from the receiving chamber and is lifted through the lifting conduit to the expelling portion;

a separation chamber fluidly coupled with the second opening and having at least one interior surface, wherein the expelling portion is disposed so that a fluid mixture expelled from the second opening is directed toward the at least one interior surface; and one or more resonator tubes, each having a first portion disposed within the separation chamber through an exhaust gas discharge port of the separation chamber and having a second portion disposed within an expulsion chamber through an exhaust gas inlet port of the expulsion chamber, wherein at least a portion of the exhaust gas is discharged from the separation chamber, through the one or more resonator tubes, into the expulsion chamber.

* * * * *